United States Patent [19]

Coble

[11] Patent Number: 4,647,022

[45] Date of Patent: Mar. 3, 1987

[54] REFRACTORY INSULATION MOUNTING SYSTEM AND INSULATED STRUCTURES

[76] Inventor: Gary L. Coble, 12065 Greenwick Rd., Homerville, Ohio 44234

[21] Appl. No.: 477,219

[22] Filed: Mar. 21, 1983

Related U.S. Application Data

[63] Continuation-in-part of Ser. No. 456,823, Jan. 10, 1983, Pat. No. 4,516,758.

[51] Int. Cl.[4] ..... C21D 9/00; F23F 5/00

[52] U.S. Cl. ..... 266/282; 432/250; 110/173 R; 266/286

[58] Field of Search ..... 266/280-286; 110/331, 336, 338-340; 432/252, 250, 249, 237, 238, 233, 251

[56] References Cited

U.S. PATENT DOCUMENTS

| | | | |
|---|---|---|---|
| 2,148,054 | 2/1939 | Berlek | 266/285 |
| 2,231,498 | 2/1941 | Geistler | 266/285 |
| 3,149,827 | 9/1964 | Whitten | 263/47 |
| 3,819,468 | 6/1974 | Sauder et al. | 161/152 |
| 3,892,396 | 1/1975 | Monaghan | 266/286 |
| 3,993,237 | 11/1976 | Sauder et al. | 228/140 |
| 4,120,641 | 10/1978 | Myles | 432/3 |
| 4,222,337 | 9/1980 | Christiansen | 110/336 |
| 4,287,839 | 9/1981 | Severin et al. | 110/331 |
| 4,300,882 | 11/1981 | Werych | 432/247 |
| 4,324,602 | 4/1982 | Davis et al. | 156/71 |
| 4,336,086 | 6/1982 | Rast | 156/71 |

FOREIGN PATENT DOCUMENTS

| | | | |
|---|---|---|---|
| 522018 | 2/1956 | Canada | 266/286 |
| 1106446 | 5/1961 | Fed. Rep. of Germany | 110/340 |
| 1490129 | 10/1977 | United Kingdom | 110/339 |
| 2095382 | 9/1982 | United Kingdom | 432/252 |
| 2096752 | 10/1982 | United Kingdom | 432/252 |

OTHER PUBLICATIONS

Lee Wilson Engineering Company, Inc., Brochure CB-6-68-5M, describes Furnaces and Auxiliary Equipment, undated.

Lee Wilson Engineering Co., Inc., "Annealing Furnace Parts—A New Program, " brochure 3M880, 1980.

Babcock & Wilcox Insulating Products Div., "Saber Bloc," brochure R932-3015 7500 F, dated 4/82.

Johns-Manville, brochures dated 7/78, 9/79, 3/80, 8/80, 9/80, 2/81, Refractory Products.

*Primary Examiner*—L. Dewayne Rutledge
*Assistant Examiner*—Christopher W. Brody
*Attorney, Agent, or Firm*—David A. Burge

[57] ABSTRACT

A structure such as a wall of a high temperature furnace door is lined with fibrous refractory insulation material which has structural fastening devices embedded therein or interleaved between planks thereof. In one embodiment, plank-like pieces of fibrous refractory material are arranged in a stack extending edgewise with respect to the wall, and sheets of expanded metal are positioned between the refractory planks and are anchored to the wall. The interleaved stack of refractory planks and expanded metal sheets are compressed such that the metal sheets become essentially embedded within the refractory material to securely grip large surface areas of the planks to hold the refractory planks in place. In preferred practice, rods extend through slots formed in the wall and connect with the expanded metal sheets to hold the sheets of expanded metal in place after the interleaved stack has been compressed. The slots in the wall parallel the direction in which the stack is compressed so that the rods are permitted to move relative to the slots during compression of the stack. In another embodiment, the expanded metal sheets form U-shaped cages into which compressed refractory planks are forced to form modules. The modules are anchored to the wall at spaced intervals, and additional planks of refractory material are compressed between adjacent ones of the modules. In still another embodiment, reinforced structures of fibrous refractory material are formed in situ about structural reinforcing and/or fastening devices so that these devices become embedded within the surrounding fibrous refractory material and cooperate therewith to form integral structures.

15 Claims, 12 Drawing Figures

REFRACTORY INSULATION MOUNTING SYSTEM AND INSULATED STRUCTURES

CROSS-REFERENCE TO RELATED APPLICATION

The present application is a continuation-in-part of application Ser. No. 456,823 filed Jan. 10, 1983, entitled DIFFUSER SYSTEM FOR ANNEALING FURNACE, hereinafter referred to as the "Parent Case," the disclosure of which is incorporated herein by reference, now U.S. Pat. No. 4,516,758.

Reference is also made to application Ser. No. 477,225 filed concurrently herewith, entitled FURNACE DOOR, hereinafter referred to as the "Companion Case," the disclosure of which is incorporated herein by reference, now abandoned.

BACKGROUND OF THE INVENTION

1. Field of the Invention

The present invention relates generally to refractory insulation mounting systems, energy-efficient systems for minimizing heat loss from such devices as high temperature furnaces used in the steel industry. Features of the invention have particularly advantageous application to a furnace door opening of a slab re-heat furnace, and are described in the environment of an exit door opening of a furnace of this type. Features of the present invention relate specifically to insulated furnace doors, and to methods for their manufacture, rebuilding and repair.

2. Prior Art

It is customary to line the walls of high temperature furnaces with refractory material to protect the furnace walls and other and structural elements against the debilitating effects of high temperature, and to minimize heat loss. The most commonly used refractory material is heavy, brittle ceramic. The weight and brittle character of this material renders it unsuitable for use on furnace doors which require frequent movement and are subject to shocks and stresses.

Furnace doors typically have been lined with relatively light, flexible refractory materials such as fibrous alumina-silica composites. These materials have been compacted to form lightweight blankets, pads or batts having handling characteristics resembling those of felt fabrics. When a thick layer of refractory insulation has been required, say 8 to 10 inches, various approaches have been tried in efforts to utilize these fibrous refractories. In some cases, blankets or batts of fibrous refractories have been applied in layered arrays using temperature-resistant adhesives. However, the mechanical strength of these fibrous refractory materials is quite low, and the exposed layers tend to slough off gradually, or to be torn away during use. Some installations utilize anchor pins which impale the layers to hold them in place, but these can readily tear through the refractory layers, and the pins tend to deteriorate as the result of exposure to the furnace heat.

Another approach to installing fibrous refractory materials has been to form the material into modules of a predetermined size. In this case, one or more blankets of fibrous refractory are folded in an accordian-like manner to produce a block of insulation material, with parallel planes of the folds extending normal to the plane of a furnace door or other furnace wall surface on which the block is to be mounted. The block, thus formed, is compressed and banded until installation.

Various types of fastening devices have been suggested for mechanically attaching these blocks to wall structures in tight contact with each other, but the proposed means of attachment have been unduly complex, time-consuming to use, and have not provided the desired type of connection needed for long service under conditions of significant heat and mechanical stress.

Furnace walls and doors which have been insulated in accordance with present-day practice deteriorate rapidly under the intense heat and mechanical shock conditions to which they are often subjected. By way of example, the exit doors on a steel slab reheat furnaces presently require rebuilding with complete replacement of the refractory material at about six month intervals. This is a costly procedure, and it is important to reduce its frequency. Ideally, door life can be increased to at least about eighteen months to correspond with the normal "campaign" life of a furnace, at the end of which time the furnace is shut down and thoroughly serviced.

3. The Referenced Applications

The referenced Parent Case describes a process for forming castings from nodular iron with cast-in-situ cooling conduits. The referenced Companion Case describes a particular application of the casting process to furnace door end guide structures, and to other components surrounding an opening of a high temperature furnace. To the degree that the preferred practice of the present invention utilizes the teachings of the Parent and Companion Cases, the benefits of the filing dates of these cases are claimed herewith.

SUMMARY OF THE INVENTION

The present invention overcomes the foregoing and other drawbacks of the prior art, particularly problems associated with attempting to provide a suitable system for attaching insulation in the form of fibrous refractory material to a wall-like structure such as the wall of a furnace door.

In accordance with the present invention, this objective is accomplished by providing a system which uses fibrous refractory material having reinforcing and/or fastening structures embedded securely within the refractory to facilitate reinforcing the fibrous refractory material, and/or connecting the fibrous refractory material to other structures. In one embodiment, relatively thick planks (e.g., two inches) of fibrous refractory material are arranged in a stack with edges of the planks engaging an external wall structure of a furnace door to be insulated. The planks of insulation are interleaved with sheets of expanded metal which engage and frictionally grip large surface areas of the faces of the planks at their interfaces. Firm gripping engagement is provided between the planks and the interleaved metal sheets by compressing the interleaved stack of planks and metal sheets to embed sheet surface irregularities into the material of the refractory planks.

The type of expanded metal sheets used in preferred practice have their inter-slit segments twisted slightly during sheet expansion to provide sheets which exhibit a high degree of stiffness, strength and roughness with many sharp edges uniformly distributed over their opposed surfaces. Since the rough expanded metal sheets engage large surface areas of the fibrous refractory planks, the planks are retained in position with substantially no tendency loosen, either at the time of door installation or during extended periods of exposure to furnace heat. The expanded metal sheets are also protected from deterioration by the refractory material which embraces these sheets.

The integral character of the resulting insulation layer on the surface of the external furnace wall or door results in a longer-lasting construction which requires much less frequent rebuilding to replace damaged or lost refractory. Since the mechanical connections which are formed between the refractory material and the external furnace wall or door member is much stronger and more evenly dispersed than heretofore, and since the refractory planks sustain a higher degree of compression upon installation than has been the case with prior constructions, the effect of shrinkage of the refractory material caused by the heat of the furnace produces much slower deterioration of the holding power of the connection, and there is much less tendency for convection and radiation heat-loss paths to open through the refractory layer. As a consequence, the heat loss factor of the furnace wall or door is significantly improved over that of the prior art, and the rebuilding interval has, in some instances, been extended some 300 percent.

In one form of practice of the invention the expanded metal sheets comprise relatively flat members sandwiched between the slabs of fibrous refractory material at alternate interfaces. The sheets are connected to the external furnace wall member by rod-like hook members with threaded shanks which extend passed through slots formed in the wall. The slots extend perpendicular to the planes of the plank faces. When a stack of refractory planks and metal sheets has been assembled, it is compressed as a unit, in a direction which parallels that of the slots. During such compression the threaded shanks move in the slots and assume their final positions, whereafter nuts are tightened in place on the threaded shanks to hold the compressed stack in place.

In an alternate embodiment of the invention, the refractory material and roughened metal sheets are preassembled into modules. In this case, the roughened metal sheets are preferably preformed into U-shaped, cage-like structures having opposed top and bottom walls interconnected by a transversely-extending base wall. The top and bottom walls are separated by a distance which is somewhat less than the thickness of two refractory planks. Two refractory planks are compressed and forced into each cage to form a module which can be attached to the furnace wall. The modules are attached to a wall with conventional fasteners, such as screws, which are arranged to connect the base walls of the cages to the furnace wall. When one course or row of these modules has been laid, two courses of planks are preferably laid on top of the course of modules, followed by another course or row of modules. As the upper course of modules is being attached to the furnace wall, it is forced downwardly to compress the intervening planks to the proper degree. In this way, a structure formed of compressed layers of insulation planks interleaved with sheets of expanded metal is formed as the installation progresses.

A feature of the modular system is that it can be used to repair damaged portions of doors which have been constructed using the previously-described system. If an accident has occurred wherein a steel slab has been jammed against a door thereby causing damage to the door's refractory layer, the damaged refractory material can be removed and a satisfactory repair made using the system of modules described above.

In still another form of the invention, fibrous refractory material is formed in situ about structural reinforcing and/or fastening devices so that these devices become embedded within the surrounding fibrous refractory material and cooperate therewith to form an integral structure. These integrally formed insulating structures are preferably held in place by elongate fasteners which connect with or form extensions of the embedded devices, and which extend through slots which have been formed in a wall or other structure to which the integrally formed insulating structures are to be attached. This method of forming insulating structures in situ about structural reinforcing and/or fastening devices has wide application and is, by no means, limited to the art of lining walls or doors of high temperature furnaces.

BRIEF DESCRIPTION OF THE DRAWINGS

These and other advantages, and a fuller understanding of the invention described and claimed in the present application may be had by referring to the following description and claims taken in conjunction with the accompanying drawings, wherein:

DESCRIPTION OF THE PREFERRED EMBODIMENT

While the preferred practice of the present invention is described and illustrated in conjunction with a movable wall such as an exit door of a slab reheat furnace used in the steel industry, it will be understood that features of the invention have wide application and are, by no means, limited to use in the environment of steel slab reheat furnaces.

Figures 1, 1A:
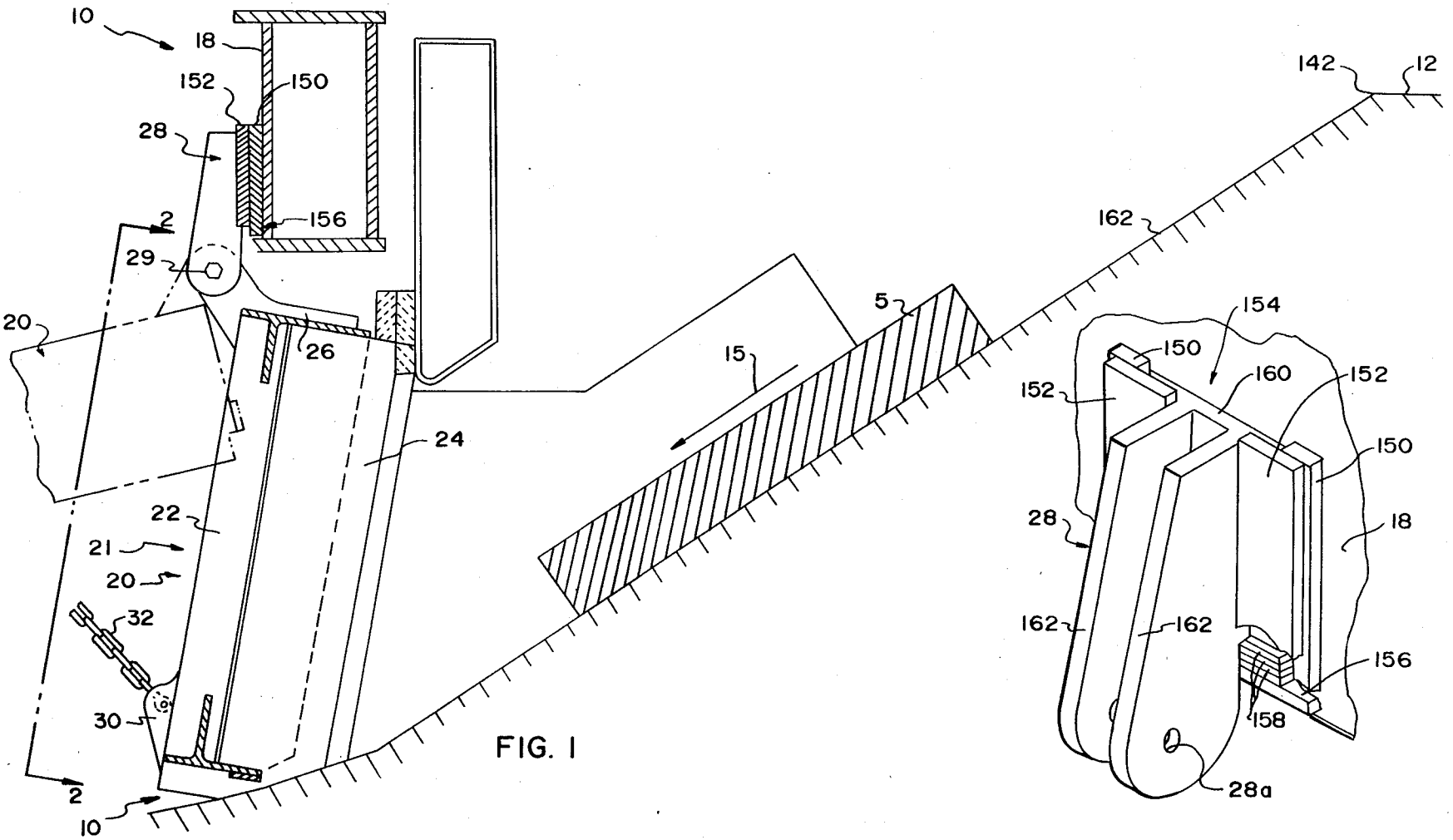
FIG. 1 is a diagrammatic cross-sectional view of a portion of the exit end of a steel slab reheat furnace, the view showing one section of a furnace exit door, and illustrating a representative environment for applying the system of the present invention.
FIG. 1*a* is a perspective view, on an enlarged scale, of a portion of the exit end of the furnace of FIG. 1, and showing portions of a vertically adjustable door hinge bracket, with portions of the bracket being broken away.

Referring to FIG. 1, an exit end of a slab reheat furnace 10 is illustrated. The furnace 10 has a floor 12 which joins at a location 14 with a descending exit ramp 16. Steel slabs, such as a slab indicated by the reference character S, are moved slowly in a sideways orientation through the furnace 10 with opposed edges of each slab in substantial contact with edges of adjacent slabs located to either side thereof. The travel time for a slab to move through the furnace 10 is selected to be of sufficient duration for the slab to reach a workable temperature which will permit the slab to be rolled or otherwise hot worked. When a steel slab such as the slab S reaches a position where its center of gravity has passed the location 14 where the floor 12 joins the ramp 16, the slab S tilts and slides down the ramp 16, as is indicated by an arrow 15 in FIG. 1.

A beam structure 18 overlies a furnace exit opening 19 located at the foot of the ramp 16, and extends the full width of a furnace exit opening 19. The height of the exit opening 19 is defined as the distance between the underside of the beam structure 18 and underlying portions of the ramp 16. Since the steel slabs S which exit through the opening 19 are quite long, typically about 25 to 30 feet, the exit opening 19 is correspondingly wide. End structures (not shown) are provided at opposite ends of the exit opening 19. As is described in the referenced Companion Case, such end structures as are provided at opposite ends of either an entry or an exit opening of a slab reheat furnace are preferably formed from nodular cast iron and include cast in situ water cooling passages. The disclosure of the Companion Case with respect to the preferred structure and preferred method for forming such end structures is incorporated herein by reference inasmuch as the type of water cooled end guides described in the Companion Case are preferably utilized where features of the present invention are practiced in conjunction with high temperature slab reheat furnace installations.

A door, indicated generally by the numeral 21, is provided for selectively opening and closing the exit opening 19. The door 21 is preferably made in two sections for convenience in handling during installation, rebuilding and repair. In FIG. 1, one of these door sections is indicated generally by the numeral 20, with the door section 20 being shown in solid lines in its closed position, and by broken lines in its open position. As will be explained in greater detail, the door section 20 includes a generally rectangular frame 22 which perimetrically surrounds and supports a layer 24 of heat insulating fibrous refractory material on its interior or high temperature surface.

Figure 2:
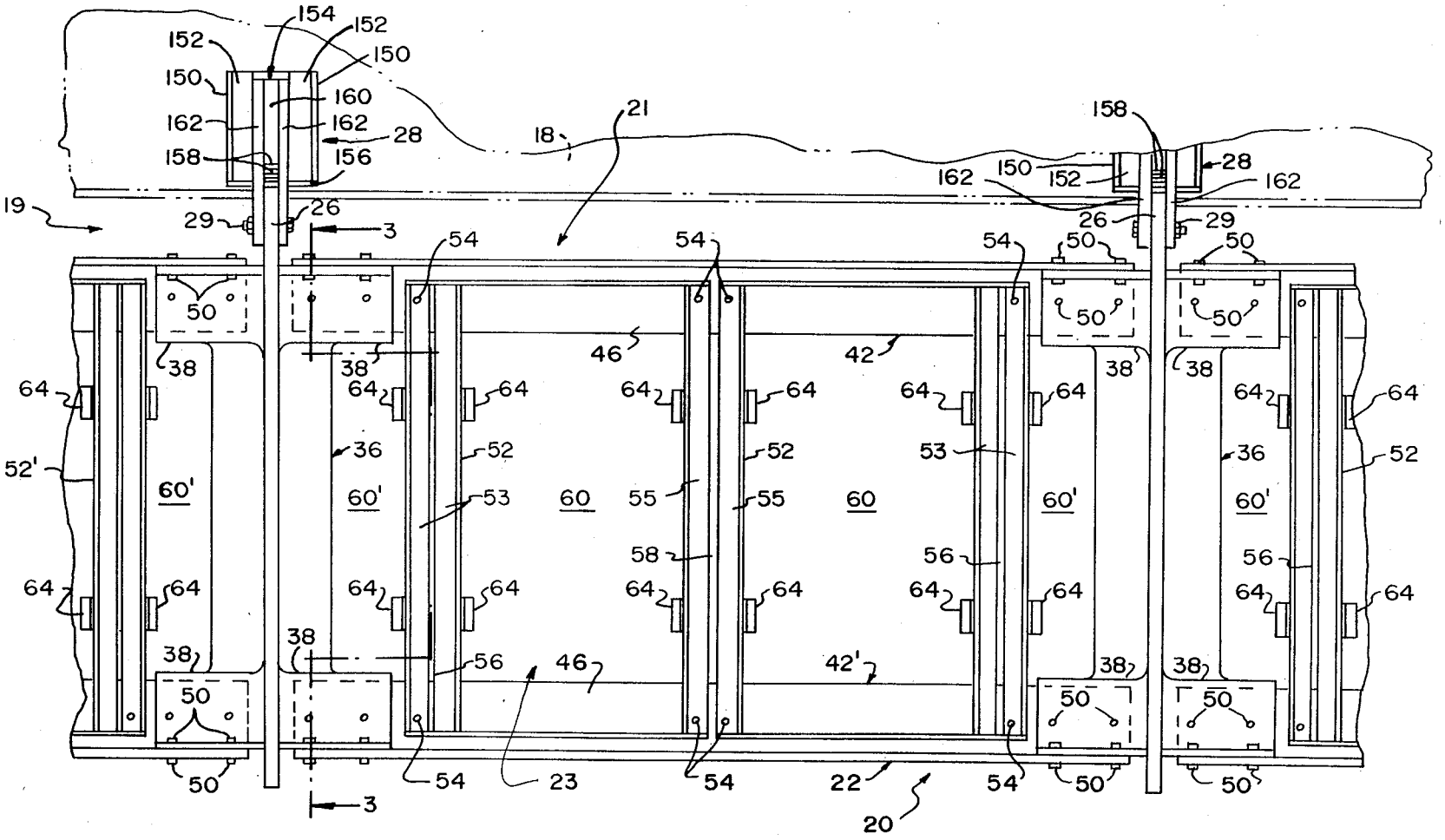
FIG. 2 is a front view of a portion of the furnace door section of FIG. 1, but with refractory material and its means of mounting being removed, the view being oriented as indicated by a line 2—2 in FIG. 1.

Referring to the sectional view of FIG. 2, the frame 22 includes an assembly of castings which perimetrically surround and define an array of inwardly facing compartments for receiving the refractory material 24. The frame 22 also provides an array of panel members 60, 60' which cooperate to define an external wall 23 to which the refractory material 24 is secured. Large, vertically-extending main castings 36 make up the primary vertical elements of the frame 22. Upper and lower cast beams 42, 42' make up the primary horizontal elements of the frame 22.

Figure 3:
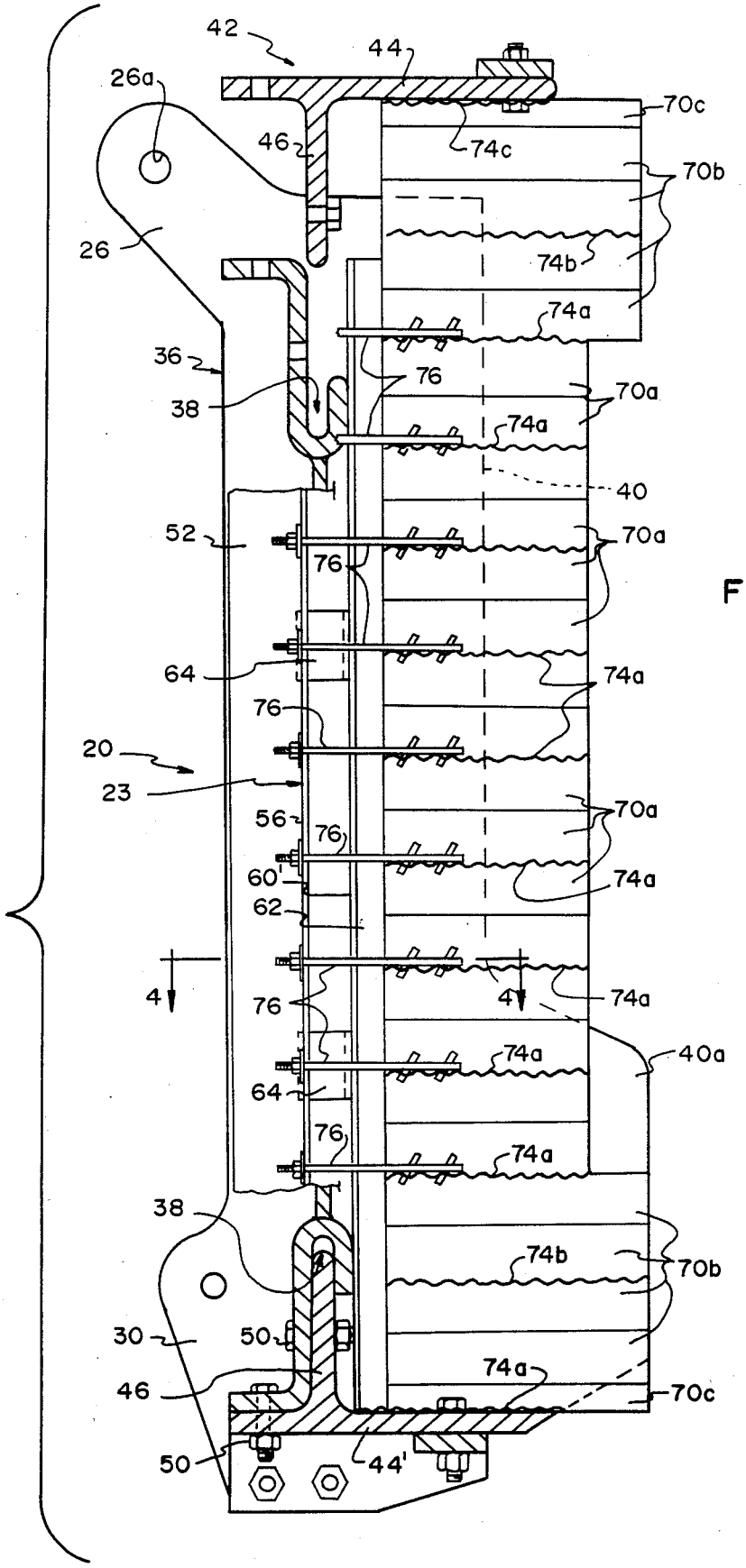
FIG. 3 is a sectional view, on an enlarged scale, as seen generally from a plane indicated by a line 3—3 in FIG. 2, but with the door's refractory material in place and with upper T-beams of the frame of the door temporarily disassociated from the rest of the frame.

While two of the main castings 36 appear in FIG. 2, it will be understood that a third main casting 36 (not shown) is spaced from one of the illustrated main castings 36 by a distance sufficient to define a second central panel area that is substantially equal in size and shape to that of the first central panel area defined between the two illustrated main castings 36. The horizontal distance between the castings 36 defines what will be referred to as a first central panel area, portions of which are occupied in part by the panel members, 60, 60', as will be described in greater detail. Moreover, the door section 20 will normally also include narrow end panel areas (not shown) which are located beyond each of two outer castings 40, but which are similar to, only smaller in size than the described main panel areas. As is best seen in FIG. 3, each of the castings 36 defines upper and lower U-shaped sockets 38, interconnected by a vertical web 40 of X-shaped cross-section. The webs 40 have inwardly-projecting, relatively wide lobes **40*a* located near their lower ends, as is best seen in FIG. 3**.

Referring to FIGS. 1, **1*a*, 2 and 3, a plurality of ears 26 are provided as integral extensions of the main support castings 36. Each of the ears 26 cooperates with a vertically adjustable bracket structure 28 which is connected to the outer vertically-extending face of the beam structure 18. The ears 26 and the bracket structures 28 have aligned holes 26*a*, 28*a* formed therethrough, respectively. Headed pins 29, or other suitable elongate fasteners, extend through the aligned holes 26*a*, 28*a* formed through the ears 26 and through the bracket structures 28 to pivotally mount the door section 20 on the beam structure 18** for movement between open and closed positions.

The bracket structure 28 has relatively movable parts which permit the axis of the holes **28*a* to be adjusted vertically so that the pivot axis of the door section 20 can be precisely positioned as desired. In this regard, reference is made to FIG. 1*a* which illustrates how the bracket structure 28 is configured. A pair of relatively narrow, elongate bars 150 are welded to the front face of the beam structure 18. A pair of relatively wider, elongate bars 152 are welded to the front faces of the bars 150 so that a vertically-extending T-slot type of channel 154 is defined between the pairs of welded structures formed by the bars 150, 152. A plate 156 is welded to the bars 150, 152 to close the lower end of the channel 154. A plurality of relatively thin shims 158 are positioned in a vertical stack atop the plate 156 at a location inside the lower end region of the channel 154. A backing plate 160 is positioned in the channel 154 with its bottom edge resting atop the stack of shims 158. A pair of spaced ear formations 162 are welded to the plate and extend forwardly and downwardly therefrom. The holes 28*a* are formed through spaced depending ear formations 162. By selecting the thicknesses and the number of the shims 158, the exact position of the axis of the holes 28*a* may be controlled as is required to properly position the door section 20. The ears 26 of the frame brackets 36 extend between pairs of the depending ear formations 162, as is best seen in FIG. 2**.

The frame 22 also has, on its exterior or cold face, a plurality of ears 30, each of which is attached to one end of a chain 32 that connects with a conventional power-operating device (not shown) for opening and closing the door sections 20. While the door sections 20 are normally closed, and are opened only briefly at appropriate intervals whenever a steel slab S exits from the furnace 10 by sliding down the ramp 16 for presentation to a conveyor (not shown) located at the foot of the ramp 16, there are installations wherein it is desirably that the door sections 20 hang in such a manner as well leave a small gap (not shown) that will permit the entry of ambient air to cool portions of the discharge chute or ramp 16. The conveyor delivers the heated steel slabs to suitable forming machinery such as a rolling mill.

The upper and lower cast beams 42, 42' are of T-shaped cross-section, as is best seen in FIG. 3. The T-beams 42, 42' have horizontally-extending flanges 44, 44', and vertically-extending flanges 46, 46'. The sockets 38 of the castings 36 receive the vertically-extending flanges 46, 46' of the upper and lower T-beams 42, 42'. Suitable threaded fasteners 50 serve to connect the castings 36 and the T-beams 42, 42' to assist in forming the rigid frame 22. Additional vertical frame members (not shown) have their opposed ends secured to the upper and lower T-beams 42, 42' near the end extremities of the door section 20 to further rigidify the construction of the door section 20.

Again referring to FIG. 2, relatively lightweight rectangular subframes 52 have their upper and lower end regions secured to the T-beams 42, 42'. The subframes 52 comprise welded assemblies of steel strips and angle irons which are connected to the T-beams 42, 42' by fasteners 54. One side of each subframe 52 is characterized by a pair of angle irons 53 which cooperate to define a narrow, vertically-extending slot 56. The other side is characterized by a single angle iron 55 which, in combination with the angle iron 55 of the adjacent subframe 52, forms a similar vertically-extending slot 58. The function of these slots 56, 58 will be discussed in detail presently. It will also be understood that similar but differently dimensioned subframes are preferably arranged to fit the narrower end panels of the frame 20, one of which is designated by the numeral 52' in FIG. 2.

What the frame structure 22 provides, in essence, are a plurality of compartments into which refractory insulation material is positioned and surroundingly contained. As well be described, the insulation material is preferably of a fibrous refractory type, which, when in its final secure-in-place form, has structural reinforcing and/or fastening members embedded therein to assist the fibrous refractory insulation material to hold its shape and remain in place. A number of embodiments of refractory structures and methods of forming and securing them in place will be described.

The refractory material 24 and the means by which it is attached to the frame 22 will now be described in conjunction with FIGS. 3, 4, 5 and 6. While FIG. 3 is essentially a sectional view, it will be understood that cross hatching of refractory material 24 has been omitted from this view in order to avoid obscuring details of the system by which the refractory material 24 is held in place. When the refractory material 24 is to be put in place, the frame 22 is preferably supported in a slightly sloping but nearly erect position, lying against a suitable fixture (not shown) with its inner or hot surface exposed and inclined slightly upwardly. The frame 22, thus positioned, presents the aspect of a series of shallow on-edge boxes with sides formed by the webs 40 and by the flanges 44, 44'.

In order to provide a surface for the refractory material 24 to rest against, center and end panel members 60, 60' are prepared to place into the frame 22. The center two panel members 60 are of sufficient height to extend between the flanges 44, 44,' and of a width defined by the distance between one of the slots 56 and the center slot 58. The narrower end panel members 60' have the same vertical dimension, but have widths that are equal to the distance from one of the webs 40 of a casting 36 to the nearest slot 56.

Each of the panel members 60, 60' comprises a sheet of steel having a layer of refractory material 62 about an inch lining its inner surface. Brackets 64 are welded to the outer surfaces of the panels 60, 60' and to the subframes 52 to hold the panels 60, 60' in place.

In FIG. 3, the frame 22 is shown as not fully assembled inasmuch as the upper T-beams 42 are shown out of engagement with the sockets 38 to illustrate one step in the process used to form the door section 20. In assembling the door section 20, the top T-beams 42 are in fact removed and set aside while the refractory material 24 is being loaded into the remainder of the frame 22. In this condition, the remainder of the parts of the frame 22 are sufficiently self-sustaining.

The refractory material 24 to be applied to the door section 20 is in the form of long planks of fibrous refractory which are relatively thick, e.g. two inches. The planks are shown as being different widths, e.g. from about eight inches to ten inches. The planks are generally designated by the numeral 70 for discussion and reference, although planks of different dimensions are designated in the drawings by the numerals **70*a*, 70*b*, 70*c***.

The length of the planks 70, for purposes of the immediate discussion, may be equal to the horizontal dimension of the region of the door section 20 which they are to fill, e.g. the distance between the webs 40 of the castings 36; alternatively, shorter planks may be laid end-to-end to form the desired length. The planks 70 are stacked one upon the other until the required number are in place. In the particular arrangement shown there are a total of twenty-six planks. The planks 70 are not, however, stacked directly one upon the other; instead elements of a mounting system are sandwiched between selected ones of planks 70, and are eventually caused to become at least partially embedded into the planks 70 as will be explained.

Important elements of the above-described mounting system embodiment include sheets of metal having special properties. Both opposed surfaces of these sheets are characterized by a special type of roughness which includes protrusions, in the form of sharp edges or points, which alternate regularly and frequently with vacuities. The protrusions are of such character as to be rather abrupt in outline, and thus are embeddable in the fibrous refractory material so that the refractory surrounds the protrusions and enters the vacuities to establish a strong across the interfaces of the sheets and planks. The protrusions are sufficiently strong to resist deformation under normal circumstances of use. For the purposes of the present discussion, surfaces having the above-described characteristics will be referred to as "rugged surfaces." The preferred way of providing a metal sheet with the desired type of rugged surfaces on both faces is to use one-eighth inch steel sheet which has been slit at regular intervals and twist-expanded to open the slits so that they define generally diamond-shaped interstices.

Figure 4:
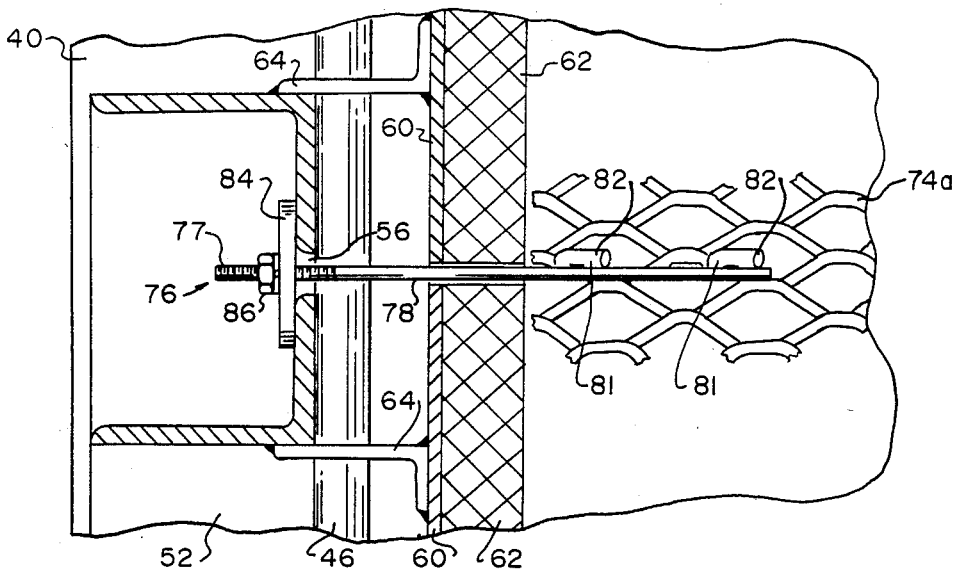
FIG. 4 is a sectional view, on a still larger scale, as seen generally from a plane indicated by a line 4—4 in FIG. 3, showing, in essence, a top plan view of a single stem form of fastening device used to hold refractory material in place on the door of FIG. 1.

In FIGS. 3 and 4, twist-expanded sheets of steel are indicated generally by the reference character 74, although the designations 74*a*, 74*b*, 74*c* are used in the drawings to indicate sheets of differing widths. As is seen in FIG. 3, rugged surface metal sheets 74*c*, 74*a* are fastened to the inner surfaces of the flanges 44, 44'. As the refractory planks 70 are stacked in place, rugged surface sheets 74*a*, 74*b*, 74*c* are interleaved between each pair of the planks 70. Prior to testing it was believed that even in the abusive environment of a steel slab reheat furnace, at least regions lying within the top and bottom portions of the stack of planks 70 would not require the use of expanded metal anchoring sheets therebetween; however, testing has shown the importance of thoroughly anchoring the planks 70 in place using metal sheets 74*a*, 74*b*, 74*c* between each pair of planks 70 where the refractory mounting system of the present invention is to be used in a highly abusive, impact-prone environment. Accordingly, in preferred practice (and especially in abusive use environments such as are present in steel slab reheat furnaces), each plank 70 has an embedded relationship between one of its faces and a ruggedly surfaced metal sheet 74. In most cases, whenever a ruggedly surfaced sheet 74 is laid in between the planks 70, an anchoring or fastening device 76 or 76' which connects with the newly positioned sheet 74 is also put in place before any further planks 70 are added.

Figure 5:
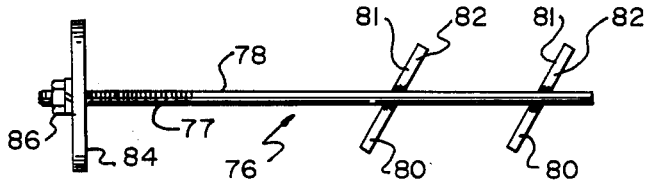
FIG. 5 is a side elevational view of the single stem fastening device of FIG. 4.
Figure 6:
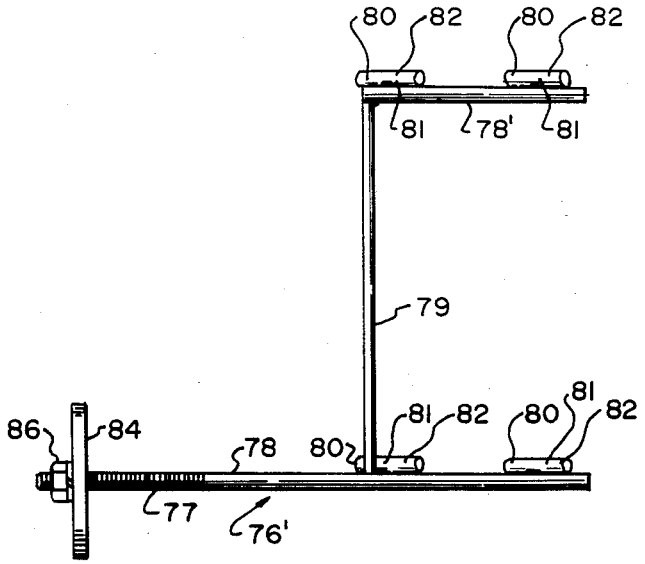
FIG. 6 is a top plan view of an alternate, dual-stem form of fastening device.

The anchoring devices 76, 76' are shown in FIGS. 4 and 5, respectively, as comprising welded assemblies of pieces of stainless steel rod. Each of the devices 76, 76' has a main mounting shank 78 which has a threaded end 77. Near the opposite ends of the shanks 78, diagonally oriented pieces 81 are welded in place. The pieces 81 have opposed ends 80, 82. The ends 80 serve as hooks which are positioned to extend through openings formed in the sheets 74 and into the material of a plank 70 located on one side of the associated sheet 74. The ends 82 extend into the material of a plank 70 located on the opposite side of the associated sheet 74.

Washers 84 and nuts 86 occupy the threaded ends 77 of the shanks 78, and serve as adjustable abutments for setting the position of the anchoring device 76, 76' with respect to the frame 22. After one of the ruggedly surfaced metal sheets 74 is laid in place, (1) several of the anchoring devices 76, 76' are laid in place above the sheet 74 at locations adjacent selected ones of the positions of the slots 56, 58, (2) the threaded ends 77 of the shanks 78 are inserted through their associated slots 56, 58 and (3) the washers 84 and nuts 86 are installed loosely in place on the shanks 78.

The purpose of the dual-stem anchoring device embodiment 76' is to provide a more secure type of attachment where a greater number of spaced points of connection with one of the ruggedly surfaced metal sheet 74 is desirable, or where a splice is to be made between two of the sheets 74 which are laid end to end and are interconnected by one of the anchoring devices 76'. The anchoring device 76' is formed by adding to the anchoring device 76 a lateral extender 79, to which is welded a short secondary shank member 78'. The shank member 78' carries diagonally attached pieces 81 which define projecting ends 80, 82, as described previously.

As the anchoring devices 76, 76' are laid in place, they are oriented so that their hook ends 80 will enter openings formed through the rugged surface metal sheets 74. When the nuts 86 are tightened to secure the sheets 74 in place, the inclined ends 80 hook securely into the sheets 74 to hold the sheets 74 in position. Both of the ends 80, 82 of the pieces 81 extend into adjacent ones of the planks 70 and serve as additional means for anchoring the planks 70 in place.

When the stack of planks 70 with its interleaved array of ruggedly surfaced metal sheets 74 and anchoring devices 76 has been assembled as described, it will extend well above the top of its assigned space, as somewhat illustrated schematically in FIG. 3. The top T-beams 42 are then positioned atop the stack and forced into in place using a conventional press or jack to compress the stack by the flanges 44, the undersides of which serve as compression surfaces engaging substantial areas of the opposed faces of the matrix-like stack of refractory planks and the ruggedly surfaced sheets 74 until the flanges 46 of the T-beams 42 are seated in the upper sockets 38 of the castings 36. The T-beams 42 are then secured to the sockets 38 by means of fasteners 50, as seen in FIG. 2.

While the compression of the stack is taking place, the shanks 78 of the anchoring devices 76, 76' travel downwardly in the slots 56, 58 and seek their final location in the slots 56, 58. Once the anchoring devices 76, 76' have reached their final locations, the nuts 86 are tightened sufficiently to place tension on the ruggedly surfaced sheets 74 and to seat edge portions of the sheets 74 firmly against the panel members 60, 60'. As will be apparent from the above-described technique, the door sections 20 which result from this construction technique can be formed rapidly and efficiently, with the resulting structures being exceedingly durable and resistant to shock. Due to the broad area of contact established between the planks of refractory material and the interleaved (essentially "embedded" ) supports, any forces which would tend to release the refractory planks 70 from within the frame 22 are well distributed, and hence are unlikely to result in one or more of the planks 70 tearing free from its mounting.

It would be possible, of course, to alternate each and every one of the refractory planks 70 with the ruggedly surfaced metal sheets 74 held in place by anchoring devices 76, 76'. However, the holding effect of the described type of arrangement of sheets 74 between pairs of the planks 70 has been proven, through experimental testing in a working environment of a steel slab reheat furnace, to be so superior to the mounting techniques of the prior art that the use of ruggedly surfaced sheets 74 at only alternate plank interfaces has been found to be entirely adequate even in abusive use installations, and is therefore preferred. The lengths of the ruggedly surfaced metal sheets 74 may be the full length of the door panel which they serve. This, however, may not always be required, especially where the use environment is not as abusive as is encountered in doors used for steel slab reheat furnaces.

To maximize the holding effect, it is preferred that the ruggedly surfaced metal sheets 74 have a width which is equal to the full widths of the planks 70. Making the sheets 74 extend flush with the inner exposed faces of the planks 70 also serves to minimize damage to the exposed refractory surface such as may result from incidental blows or abrasion. Moreover, if a severe blow to the inner exposed surface of the refractory is sustained, the effect of the blow is to bend or "roll over" the exposed edge of such ones of the metal sheets 74 as were struck, whereby the damaged area of the refractory is caused to be held even more securely in tact.

In impact-prone environments such as are encountered in steel slab reheat furnaces, testing of a prototype door has shown that it is incorrect to rely primarily on compression of the interleaved stack of planks 70 and sheets 74 to hold the refractory stack in place. Rather, the metal sheets 74 must indeed be securely connected to the frame 22, for example by the use of a relatively generous supply of the anchoring devices 76, 76'. Moreover, testing has shown the desirability of configuring such portions of the frame 22 as surround and define the compartments within which the interleaved stacks of planks 70 and sheets 74 are positioned to have inner edge portions which at least extend flush with (if not inwardly beyond) the exposed inner face of the refractory material to assist in protecting the refractory. Still another discovery resulting from testing is that expanded metal sheets formed from relatively lightweight material such as number 304 stainless steel may be used to minimize door weight without compromising the required anchoring function.

Referring to FIG. 3, it will be noted that the inwardly-extending lobes 40*a* which are provided on the castings 40 are designed to extend flush with the inner surface of lower ones of the refractory planks 70 to protect these lower planks against damage to the fibrous refractory layer in case the door section 20 is not opened in time to avoid contact with a heated steel plank which is descending along the ramp 16. Other appropriately configured lobes or projections (not shown) may be provided on the door frame 22, as desired, to engage exiting in installations where it is desired to utilize slab contact with the door as the motive force for opening the door.

While the structure and process hereinabove described have been specifically related to the exit door of a steel slab re-heat furnace, it will readily be understood that features of the invention apply equally well to fixed walls as well as doors, and to furnaces, kilns and insulated structures of other types.

Figure 7:
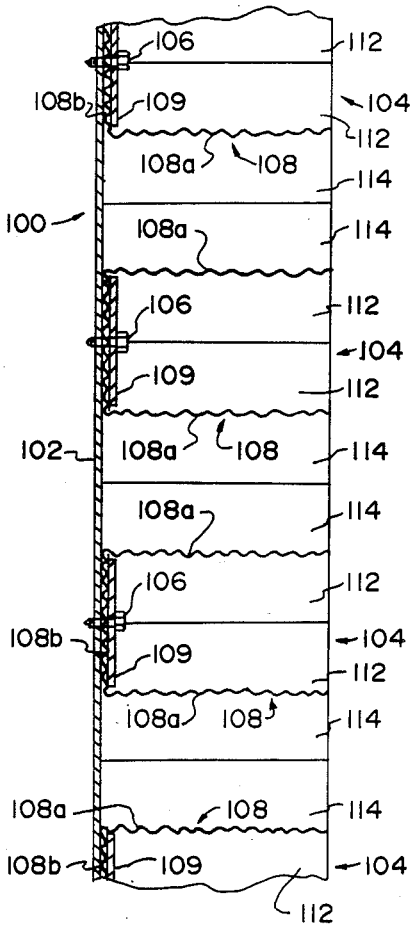
FIG. 7 is a sectional view, similar to FIG. 3, of an alternate system for attaching refractory material to a furnace wall member using a module-mounting technique.
Figure 8:
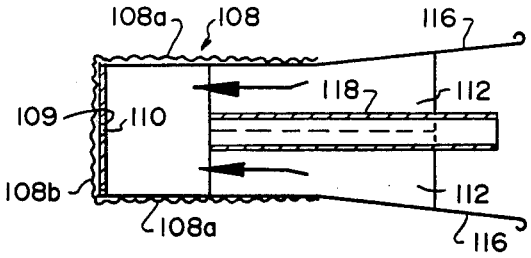
FIG. 8 is a sectional view, similar to FIG. 7, schematically illustrating a step in the process of assembling a refractory module for use in the door construction illustrated in FIG. 7.
Figure 9:
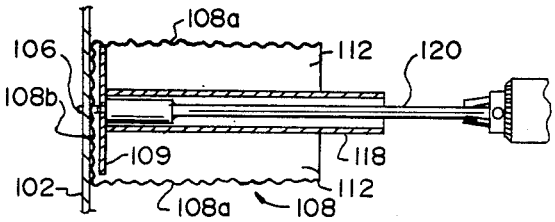
FIG. 9 is a sectional view, similar to FIG. 7, schematically illustrating a preferred procedure for installing a threaded fastener by using a power tool to effect wall mounting of a refractory module of the type shown in FIG. 7.

FIGS. 7, 8 and 9 illustrate a second embodiment of the invention which may be used to advantage in various applications, both to repair damaged portions of refractory insulation in installations of the type described previously, and to provide an alternate embodiment of insulation mounting system for lining whole walls and door structures. While FIGS. 7–9 are cross-sectional in nature, cross hatching of the fibrous refractory planks shown in these FIGURES has been omitted to permit details of construction to be viewed with ease. In these FIGURES, the numeral 100 indicates an insulated portion of a wall of a furnace, or kiln or other insulated structure. An exterior sheet metal wall member 102 defining a wall to be insulated has attached thereto a series of spaced modules 104 anchored to the wall 102 by suitable fasteners 106, such as self-tapping screws. Each module 104 consists of a relatively rigid, three-walled cage 108. Each cage 108 is formed by bending a sheet of ruggedly surfaced metal, preferably of shear expanded steel. The cage 108 is of generally U-shape, having two refractory retention walls 108*a*, 108*a'*, and a base wall 108*b*. Preferably, a thin metal plate 109 is seated against the interior surface of the mounting wall 108*b*. Referring to FIG. 8, openings 112 formed in the plate 109 allow for the passage of fasteners 106 and prevent the escape of fastener heads through the relatively large apertures in the twist-expanded metal of the cage 108.

Housed within the cage 108 are two planks of fibrous refractory material 112, 112' which are normally jointly thicker than the height of the cage 108, but which have been compressed and forced into the cage 108. For example, if the material of each of the planks 112 is normally two inches thick, the cage 108 would be formed with a space between its upper and lower walls 108*a*, 108*a'* of perhaps three and one-half inches, and the four inches of plank material would be compacted and forced to be held in a compressed state. The modules 104 are then be mounted about three and one-half inches apart, with two compressed planks 114 held between each pair of adjacent modules 104.

FIG. 8 illustrates an effective way of assembling a module 104. After the plate 109 is placed within the cage 108, a pair of guide sheets 116, 116' are placed with the cage 108. The guide sheets 116, 116' are preferably formed of thin polished metal and are somewhat flexible and resilient. Their length is at least equal to the length of the planks 112 of fibrous refractory material to be inserted, and preferably equal to the full length of the cage 108. The sheets 116, 116' cooperate to form a smooth walled funnel which allows the planks 112, 112' to be forced edgewise into the cage without becoming snagged on the rugged surfaces of the walls 108*a*, 108*a'*. When the planks 112, 112' are seated, the guide sheets 116, 116' are withdrawn, allowing the planks 112, 112' to expand into gripping embrace with the projections of the rugged surfaces of the retention walls 108*a*, 108*a'*.

Preferably, before the planks 112, 112' are inserted into the cage 108, there will be introduced between the planks 112, 112' at predetermined points, a number of stiff, smooth-surfaced tubes 118 which will preserve temporary openings between the planks 112, 112' for access to the openings 110 in the plate 109. The module 104 can then be mounted on the wall 102 by introducing a drive tool 120 and a fastener 106 through each of the tubes 118.

When a module 104 has been attached to the wall 102, the tubes 118 can be readily grasped and withdrawn, whereupon the refractory material will expand to close the passages which were previously formed by the tubes 118. Alternatively, in the event that the tubes 118 are formed of readily combustible material such as cardboard, they may be allowed to remain, and be consumed by the high furnace temperatures to which they will be exposed in use.

The completed wall assembly of FIG. 7 may be efficiently erected in a number of ways. In one preferred procedure, the refractory elements are progressively mounted. What is meant by this is that a first module 104 is attached to the bottom of the metal wall member 102, whereafter two planks 114 of refractory material are placed atop the installed module 104, followed by the placing of a second module 104 atop the two planks 114. While sufficient pressure is being applied to the stack thus far assembled to compress the two planks of refractory 114 to a predetermined degree, the installed modules 104 are secured in place. The principle of this procedure is then repeated, layer by layer, until the wall member 102 is covered.

An alternate procedure which works equally effectively involves first attaching the modules 104 to the wall member 102 at spaced intervals. The spacing between the modules 104 is set to define the desired compressed thickness of two planks of refractory material 114 (which is essentially equal to the height of a module 104). Finally, pairs of planks 114 of refractory material are introduced into the space between each pair of modules 104. This can be done using the guide sheets 116 in a manner similar to that described for stuffing a module.

Figure 10:
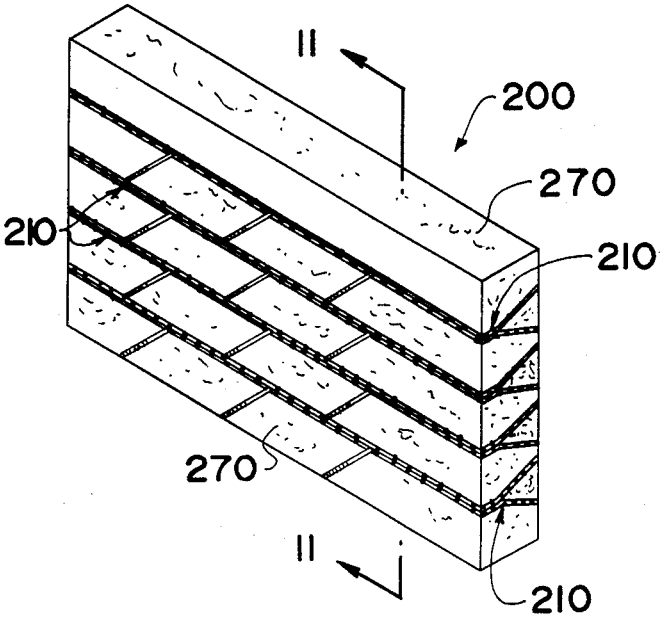
FIG. 10 is a perspective view illustrating portions of an integral reinforced fibrous refractory structure which incorporates still with other features of the practice of the present invention; and, FIG. 11 is a sectional view, on an enlarged scale, as seen generally from a plane indicated by a line 11—11 in FIG. 10.
Figure 11:
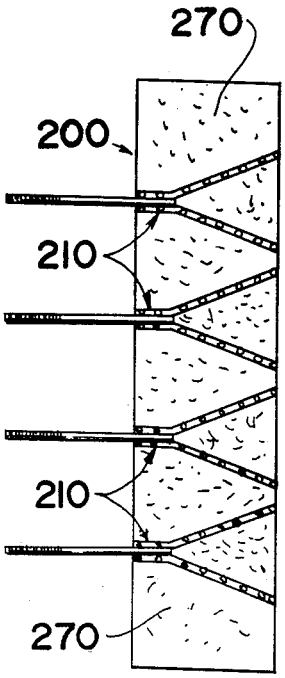

FIGS. 10 and 11 illustrate still another embodiment of the invention which may be used to advantage in not only the types of furnace applications described previously but also in conjunction with a wide variety of other applications wherein insulation material needs to be securely structurally supported. A self-sustaining structural body of fibrous, refractory insulation material is indicated generally by the numeral 200. The body 200 includes fibrous refractory material 270 which has been formed in situ about a plurality of structural reinforcing and/or fastening devices, indicated generally by the numeral 210. The devices 210 are embedded in the body 200 and, together with the fibrous refractory material 270, cooperate to form a reinforced integral body 200.

The devices 210 are illustrated as including a plurality of ruggedly surfaced metal sheets 274, with pairs of the sheets 274 being welded or otherwise suitably connected to a plurality of elongate anchoring devices 276. The anchoring devices 276 are threaded, in the manner of the previously described anchoring devices 76, so that one of the relatively large bodies 200 can be substituted for one of the previously described interleaved stacks of refractory planks 70 and metal sheets 74, as well as for the anchoring devices 76.

In forming the body 200, such portions of the structural devices 210 as are to be embedded within the body 200 are supported in a suitable jig (not shown), whereafter fibers of the refractory material 270 are caused to collect or otherwise take up positions about the structural devices 210. The fibers of the material 270 either carry a suitable adhesive bonding agent, or such an agent is sprayed onto these fibers as they collect to form the body 200. Once the fibers are bonded in place with the desired portions of the devices 210 being embedded among the bonded fibers to form the integral body 200, the devices 210 serve to reinforce the body 200 as well as to provide a suitable means for connecting the body 200 to another structure such as a wall portion of a furnace door.

Such portions of the devices 210 as are caused to be embedded within the body 200 can take any of a variety of forms such as the general configurations of various types of gridwork commonly used in conjunction with the reinforcing of concrete structures. While the devices 210 have been illustrated as having threaded rods connected rigidly thereto and extending externally of the body 200, the devices 210 can be formed in a way which will not necessitate that the anchoring rods 276 be formed as rigid extensions thereof. Instead, the devices 210 can include eyelet formations (not shown) or other suitable connecting formations (not shown) which will permit other suitably configured conventional mounting means (not shown) to connect therewith.

In present day technology, high heat refractory fibers are made into planks, such as those which have been described previously in conjunction with the numeral 70, by collecting and bonding airborne fibers on one side of a collecting screen (not shown). The collecting screen has a mesh of such size as will permit it to restrain and collect the airborne fibers as air which carries the fibers is drawn through the screen. Just as fibers can be formed into the planks 70, they can similarly be caused to collect or otherwise form about suitably configured reinforcing grids (not shown) or a plurality of other types of reinforcing and/or fastening devices 210 embedded within the body 200. While FIGS. 10 and 11 illustrate a very simple form of reinforcing system about which refractory fibers 270 can be collected to form a body 200, it will be understood that a wide variety of three-dimensional networks of metal, metal matrices, webs, skeletons, and the like can be utilized in place of the described types of devices 210 to assist in providing a self-supporting body 200 of reinforced fibrous insulation material.

A feature of the structural arrangement of the described form of the body 200 is that it can be compressed, in the manner described previously (in conjunction with the stack interleaved array of planks 70 and sheets of metal 74), to facilitate a rigid structural containment of the body 200 within the confines of a furnace door frame, of the type described previously in conjunction with the numeral 22. While the structures 210 have been illustrated as each including a pair of expanded metal sheets 274*a*, 274*b* attached to a plurality of elongate threaded fastening devices 276, it will be understood that relatively flat, single sheets of expanded metal (as described previously in conjunction with the numeral 74) can be used with threaded fastening devices which are either hooked into the metal sheets at spaced intervals along their lengths (as described previously) or welded to the expanded metal sheets.

While the foregoing description has been specifically directed to the erecting of a complete wall, it will be readily appreciated that the techniques described, either individually or in combination, may be effectively used for repairing portions of such wall-mounted refractory material as may have sustained local damage.

Although the invention has been described with a certain degree of particularity, it will be understood that the present disclosure of the preferred embodiment has been made only by way of example, and that numerous changes in the details of construction and the combination and arrangement of elements can be resorted to without departing from the true spirit and scope of the invention as hereinafter claimed. It is intended that the patent shall cover, by suitable expression in the appended claims, whatever features of patentable novelty exist in the invention disclosed.

What is claimed is:

1. An insulated wall for a high temperature furnace, comprising:

(a) an external wall member;

(b) a layer of refractory insulation positioned on an interior side of the external wall member, the insulation layer being formed from a plurality of individual planks of fibrous refractory material, with the planks arranged in a stack that has opposed walls of adjacent ones of the planks extending in planes that are substantially parallel to each other, with the stack itself having opposed faces;

(c) frame means including compression surfaces for engaging substantial areas of the opposed faces of the stack, for compressing the stack of planks in a direction that will force adjacent ones of the planks throughout the stack relatively toward each other, and for retaining the stack of planks in a compressed condition; and, (d) attaching means for connecting the stack of planks in relation to the wall member, including ruggedly surfaced metal sheets disposed substantially coextensively with said planks embedded within the layer of fibrous refractory material at locations between adjacent ones of the planks, and connection means for connecting the ruggedly surfaced metal sheets to the external wall member.

2. The insulated furnace wall of claim 1 wherein:
(a) the ruggedly surfaced metal sheets are expanded metal sheets;
(b) the attaching means includes elongate, rod-like structures;
(c) the external wall member is provided with slots extending in directions that are substantially perpendicular to the planes of the opposed walls; and,
(d) the rod-like structures extend through the slots and are securely connected to the frame means.

3. The insulated furnace wall of claim 2 wherein the frame means compression surfaces include spaced, substantially parallel-extending flanges connected to the external wall member and holding the layer of refractory insulation in compressive engagement.

4. The insulated furnace wall of claim 3 additionally including removable fastener means for connecting at least one of the flanges to the external wall member so that it is readily attachable thereto and removable therefrom.

5. The insulated furnace wall of claim 1 wherein the frame means compression surfaces include spaced, substantiallly parallel-extending flanges connected to the external wall member and holding the layer of refractory insulation in compressive engagement, wherein the external wall member is provided with slots extending in directions substantially perpendicular to the planes of the parallel-extending flanges, and wherein the connection means comprise rods, each of the rods being connected to at least one of the metal sheets, each of the rods projecting through one of the slots, and each of the rods being provided with adjustable abutment means for engaging the wall member.

6. The insulated furnace wall of claim 5 wherein the ruggedly surfaced metal sheets have openings formed therethrough, and wherein each of the rods is provided with a hook formation for engaging one of the openings.

7. The insulated furnace wall of claim 1 wherein the ruggedly surfaced metal sheets are connected rigidly to the connection means.

8. The insulated furnace wall of claim 1 wherein the layer of refractory insulation defines an inner surface for facing toward the interior of a furnace, and the frame means includes formation means for extending flush with at least portions of the inner surface for protecting adjacent parts of the inner surface portions in the event of impact.

9. The insulated furnace wall of claim 1 wherein the ruggedly surfaced metal sheets are interleaved between adjacent ones of the planks.

10. An insulated furnace wall for a high temperature furnace, comprising:
(a) an external wall member;
(b) a layer of refractory insulation positioned on an interior side of the external wall member, the insulation layer being formed from fibrous refractory material;
(c) frame means including compression surfaces for compressing the stack of planks over a substantial area and for retaining the stack of planks in a compressed condition;
(d) attaching means for connecting the stack of planks in relation to the wall member, including ruggedly surfaced metal sheets disposed substantially coextensive with said planks embedded within the layer of fibrous refractory material, and connection means for connecting the ruggedly surfaced metal sheets to the wall member; and
(e) the layer of refractory insulation being formed in situ about the connection means, whereby the layer is an integral structure that is reinforced by the embedded connection means.

11. An insulated furnace wall for a high temperature furnace, comprising:
(a) an external wall member provided with spaced elongate slots extending in a first direction;
(b) a body of fibrous refractory insulation on an interior side of the external wall member, the body being formed from a plurality of layers of fibrous material that overlie each other to form a stack that has opposed faces;
(c) sheets of expanded metal embedded within the body of fibrous refractory material, said sheets being substantially coextensive in area with said layers;
(d) anchoring devices for connecting the sheets of expanded metal with the external wall member, including rods each extending through one of the slots and provided at one end with a hook for engaging an opening in one of the expanded metal sheets, and at the other end with an adjustable abutment; and,
(e) opposed flanges defining compression surfaces on the external wall member for engaging substantial areas of the opposed faces of the stack, for compressing the stack to distribute compressive forces throughout the layers of the stack, and for maintaining the stack of interleaved planks and sheets in a compressed condition.

12. The insulated furnace wall of claim 11 wherein the body of refractory insulation includes planks of fibrous refractory material stacked edgewise with respect to the external wall member and with the planes of the opposed faces of the planks extending substantially perpendicular to the lengths of the slots formed through in the external wall member, and the sheets of expanded metal are interleaved between selected ones of the planks.

13. The insulated furnace wall of claim 12 wherein the sheets of expanded metal are interleaved between adjacent planks of fibrous refractory material only at alternate interfaces thereof.

14. An insulated furnace wall for a high temperature furnace, comprising:
(a) an external wall member provided with spaced elongate slots extending in a first direction;
(b) a layer of fibours refractory insulation on an interior side of the external wall member;
(c) sheets of expanded metal embedded within the layer of fibrous refractory material and substantially coextensive with said refractory layer;
(d) anchoring devices for connecting the sheets of expanded metal with the external wall member, including rods each extending through one of the slots and provided at one end with a hook for engaging an opening in one of the expanded metal sheets, and at the other end with an adjustable abutment;
(e) opposed flanges on the external wall member defining compression surfaces for engaging substantial areas of opposed faces of the fibrous refractory insulation and the sheets or expanded metal for maintaining the same in compressed condition; and, (f) the layer of refractory insulation being formed in situ about the connection means whereby the layer is an integral structure that is reinforced by the embedded connection means.

15. An insulated furnace wall for a high temperature furnace, comprising:

(a) an external wall member having portions thereof defining opposed compression surfaces;

(b) a sequence of elongate three-walled, U-shaped cages mounted on the inner surface of the external wall member with their open sides directed away from the external wall member, the cages being formed of ruggedly surfaced metal sheets and designed for cooperation with planks of fibrous refractory material of predetermined thickness, the openings of the cages and the space inbetween cages being substantially equal and having a dimension less than the normal thickness of two of the planks;

(c) a pair of elongate superimposed planks of fibrous refractory material in each cage;

(d) a pair of superimposed planks between each adjacent pair of cages, all of the planks and cages being received between said compression surfaces and retained in compressed condition thereby; and, (e) each of the metal sheet cages being substantially identical in length to the length of the planks of fibrous material contained therein whereby said cages and said planks are substantially coextensive in area.

* * * * *